US009835407B2

(12) United States Patent
McLean

(10) Patent No.: US 9,835,407 B2
(45) Date of Patent: Dec. 5, 2017

(54) APPARATUS FOR CHANGING BETWEEN A TWO-POINT SLING STATE AND A ONE-POINT SLING STATE

(71) Applicant: McLean Corp., Norfolk, VA (US)

(72) Inventor: Neil Richard McLean, Norfolk, VA (US)

(73) Assignee: McLean Corp., Norfolk, VA (US)

( * ) Notice: Subject to any disclaimer, the term of this patent is extended or adjusted under 35 U.S.C. 154(b) by 130 days.

(21) Appl. No.: 15/064,176

(22) Filed: Mar. 8, 2016

(65) Prior Publication Data

US 2017/0191793 A1 Jul. 6, 2017

Related U.S. Application Data

(60) Provisional application No. 62/272,689, filed on Dec. 30, 2015.

(51) Int. Cl.
*A45F 4/00* (2006.01)
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... A47B 81/005; F41C 33/002; F41C 23/02; A45F 4/00; A45F 4/02; A45F 4/04; A45F 4/06; A45F 4/08; A45F 4/10; A45F 4/12; A45F 4/14; A45F 2004/00
USPC ..... 224/150, 575, 913
See application file for complete search history.

(56) References Cited

U.S. PATENT DOCUMENTS 1,332,088 A * 2/1920 Wagner ..... F41C 23/02 224/150
1,383,125 A * 6/1921 Kennedy, Jr. ..... F41C 33/001 224/150
2,446,197 A * 8/1948 Sloan ..... F41C 33/001 224/150
3,441,185 A * 4/1969 Moomaw ..... F41C 33/001 224/150
8,544,153 B2 * 10/2013 Mayberry ..... F16B 2/10 224/150
8,596,504 B2 * 12/2013 Haley, Sr. ..... F41C 23/02 224/149
9,146,074 B1 * 9/2015 McCarthy ..... F41C 23/02
9,157,700 B1 * 10/2015 Hansen ..... F41C 23/02
9,410,766 B1 * 8/2016 Falla ..... F41C 33/002
9,746,284 B2 * 8/2017 McCarthy ..... F41C 33/002
2007/0257072 A1 * 11/2007 Pena ..... F41C 23/02 224/150

(Continued)

*Primary Examiner* — Brian D Nash

(57) ABSTRACT

The sling comprises at least one strap defining a loop. The loop is to be positioned over a user's first shoulder and under a user's second shoulder. A first attaching member couples a first part of the loop to a first part of a weapon. A cam buckle is coupled to a second part of the loop and is for adjusting the size of the loop when a first force acts on a lever of the cam buckle. A trigger snap hook is coupled to a third part of the loop and is for removably coupling the loop to a second part of a weapon. A gate of the trigger snap hook is configured to open when a second force acts on a trigger of the trigger snap hook. A linking member couples the trigger of the trigger snap hook to the lever of cam buckle.

20 Claims, 8 Drawing Sheets

(56) References Cited

U.S. PATENT DOCUMENTS

| | | | | |
|---|---|---|---|---|
| 2010/0206921 | A1* | 8/2010 | Shen | F41C 33/002 224/150 |
| 2013/0097822 | A1* | 4/2013 | Mayberry | F16B 2/10 24/509 |
| 2014/0091115 | A1* | 4/2014 | Haley | F41C 23/02 224/150 |
| 2014/0203053 | A1* | 7/2014 | Rivas-Schlanger | F41C 33/002 224/150 |
| 2015/0292835 | A1* | 10/2015 | McCarthy | F16B 45/02 24/599.6 |
| 2016/0120280 | A1* | 5/2016 | Dingler | A45C 3/02 224/608 |
| 2016/0265873 | A1* | 9/2016 | Schuman | F41C 33/002 |
| 2017/0254616 | A1* | 9/2017 | Phillips | F41C 33/007 |

* cited by examiner

APPARATUS FOR CHANGING BETWEEN A TWO-POINT SLING STATE AND A ONE-POINT SLING STATE

CROSS-REFERENCE TO RELATED APPLICATIONS

This application claims the benefit of the filing date of U.S. Provisional Application Ser. No. 62/272,689 filed Dec. 30, 2015 titled "Quick Release Snap Hook" and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of weapons and more specifically to the field of slings used for carrying rifles.

BACKGROUND

The arms and weapons industry is a global business encompassing the manufacturing of weapons, military technology and equipment. It is estimated that yearly, over 1.5 trillion United States dollars are spent on arms and weapons industry expenditures worldwide. The arms and weapons industry is enormous.

In the context of firearms, a sling, or gun sling, is a type of strap or harness designed to allow a shooter to carry a firearm (usually a long gun such as a rifle, carbine, shotgun, or submachine gun, etc.) on his/her person. For the purposes of this document, there are two main types of gun slings, (1) a one-point gun sling, and (2) a two-point gun sling.

A two-point gun sling has two connection points that attach near to the front and rear of the weapon. The two-point gun sling allows the shooter to carry the weapon over his/her back, with the sling draped across the torso, around the neck or over one shoulder. Some two-point slings may be adjustable so that the circumference of the sling can be increased or decreased. A two-point sling is cumbersome and does not allow you to make dynamic movements with a rifle, such as switching shoulders or shooting from a prone position. The two-point gun sling can interfere with the shooter's movement and hang up on the shooter's gear.

A one-point sling only attaches on the weapon at one connection point. The one-point sling design permits the shooter to transition to firing from the opposite shoulder. This sling design is best suited for short-term tactical use. One of the negative attributes of the one-point sling includes a tendency to make the rifle dangle and hang off the shooter in an inconvenient fashion. The one-point gun sling can interfere with the shooter's movement and hang up on the shooter's gear. The one-point gun sling does not allow the user to be hands free and still maintain positive control of the firearm or weapon.

Some devices have been developed to allow a user to convert or change between a two-point sling state and a one-point sling state. However, such devices are very inefficient time-wise and can be cumbersome to use. When milliseconds can be the difference between life and death, the current prior art devices that provide slings convertible between a two-point sling state and one-point sling state can be relatively time consuming. As a result, there exists a need for improvements over the prior art, and more particularly, for a better apparatus that enables an operator to more quickly, carry and access a weapon when necessary.

SUMMARY

A system and apparatus for changing between a two-point sling state to a one-point sling state is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a sling configured to change between a two-point sling state and a one-point sling state is disclosed. The sling comprises at least one strap defining a loop. The loop is to be positioned over a user's first shoulder and under a user's second shoulder. A first attaching member is coupled to a first part of the loop and couples the loop to a first part of a weapon. A cam buckle is coupled to a second part of the loop and is for adjusting a circumference of the loop. The circumference of the loop can be increased when a first force acts on a lever of the cam buckle. A trigger snap hook is coupled to a third part of the loop and removably couples the trigger snap hook to a second part of a weapon. The trigger snap hook is configured to be biased closed. A gate of the trigger snap hook is configured to open when a second force acts on a trigger of the trigger snap hook. A linking member couples the trigger of the trigger snap hook to the lever of cam buckle.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein:

FIG. 3D illustrates a portion of curved elements and stacked overlapping protrusions of the attaching member, or trigger snap hook of the sling, according to an example embodiment;

FIG. 5B illustrates a user's hand applying force in the direction of line A to a linking member such that a cam buckle of the sling allows the circumference of the sling to be increased so that the user has room to maneuver the rifle, according to an example embodiment;

FIG. 6B illustrates a user's hand applying force in the direction of line B to a linking member such that the attaching member or trigger snap hook is in an open state allowing the user to de-couple the trigger snap hook from the rifle, according to an example embodiment;

FIG. 7B illustrates a user's hand applying force in the direction of line C to a portion of the sling thereby decreasing the circumference of the sling, according to an example embodiment;

DETAILED DESCRIPTION

Figure 1:
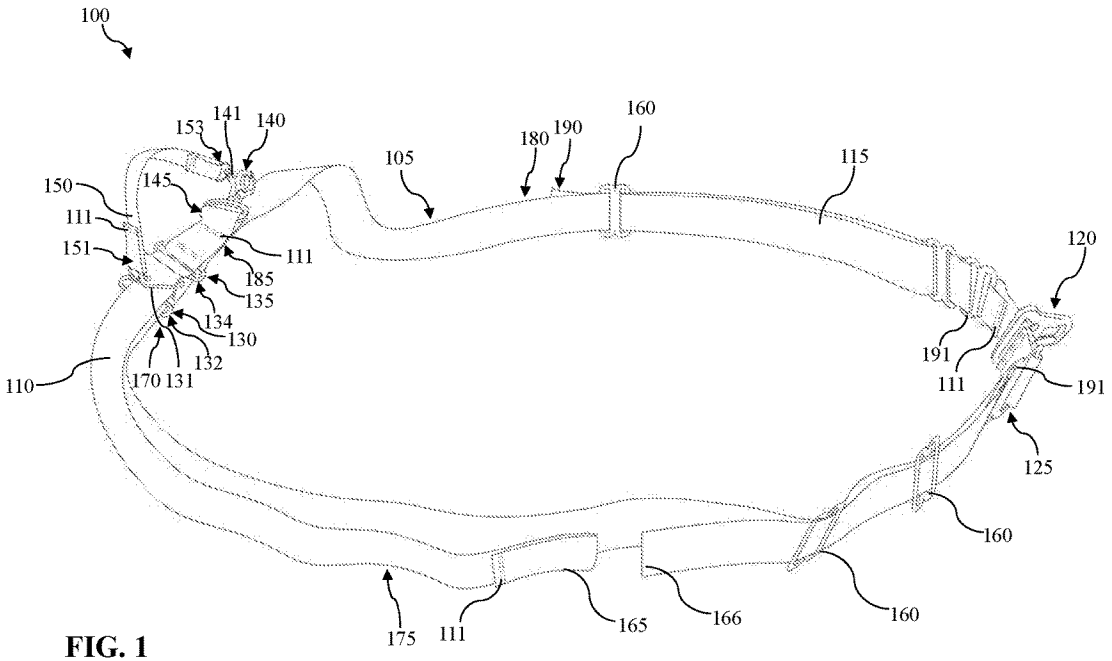
FIG. 1 is a perspective view of a sling configured for changing between a two-point sling state and a one-point sling state, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing an apparatus for changing between a two-point sling state and a one-point sling state. The apparatus may include a sling, or a device that is attachable to a one-point sling having a cam buckle for adjusting the circumference of the sling. The invention provides a linking member that allows a user to change between a one-point sling state to a two-point sling state, then back to a one-point sling state very quickly and with an optimized minimal amount of movement or force. The invention also provides overlapping curved features forming protrusions stacked on top each other. The overlapping features and protrusions of the trigger snap hook or attaching member provide an additional stop feature that prevents inadvertent de-coupling of the weapon from a two-point sling state to a one-point sling state. The trigger snap hook is also positioned such that the sagittal plane of the body of the trigger snap hook is substantially aligned with the longitudinal axis of the strap so that a gate of the trigger snap hook rotates in the direction of the cam buckle of a gun sling.

Referring now to the Figures, FIG. 1 is a perspective view of the sling 100. The sling is configured for changing between a two-point sling state (see FIGS. 4, 5A and 7A and explained below) and a one-point sling state (see FIG. 6A and explained below). The sling includes at least one strap configured to define a loop 105. In the present embodiment two straps, a first strap 110 and a second strap 115 are configured to couple with each other. However, in other embodiments different amounts of straps may be used to form the loop. The strap may be webbing, or strong, closely woven fabric used for straps, belts, etc. The material comprising the straps may cotton, flax, synthetic fibers such as nylon, polypropylene or polyester, Dyneema, and Kevlar etc. or any combination thereof. However, this is not meant to be a limitation and other types of materials may be used and are within the spirit and scope of the present invention. The loop is configured is to be positioned over a user's first shoulder and under a user's second shoulder so that the sling crosses a user's torso as illustrated in FIGS. 4, 5A, 6A, and 7A.

The sling includes a first attaching member or snap hook 120 coupled to a first part of the loop 105. The first attaching member is configured to couple the loop to a first part of a weapon (see 410 of FIG. 4). In the present embodiment, the first attaching member is a snap hook or a hook with a spring biased gate that allows entrance but prevents the escape of a cord, key ring, etc. . . . Snap hooks are well known to those skilled in the art, however other attaching means are also within the spirit and scope of the present invention. Other fasteners may also be used such as a u-bolt, bolts, straps, etc. The first attaching member is more clearly illustrated in FIGS. 2A-B.

Figure 2B:
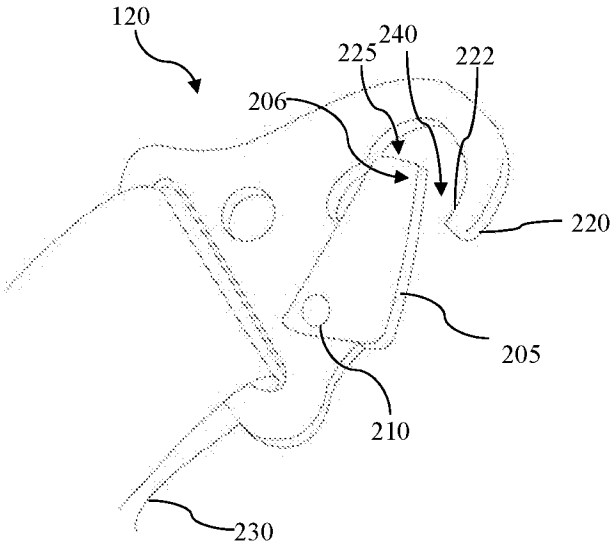
FIG. 2B is a perspective view of the first attaching member or snap hook of the sling in an open position, according to an example embodiment.
Figure 2A:
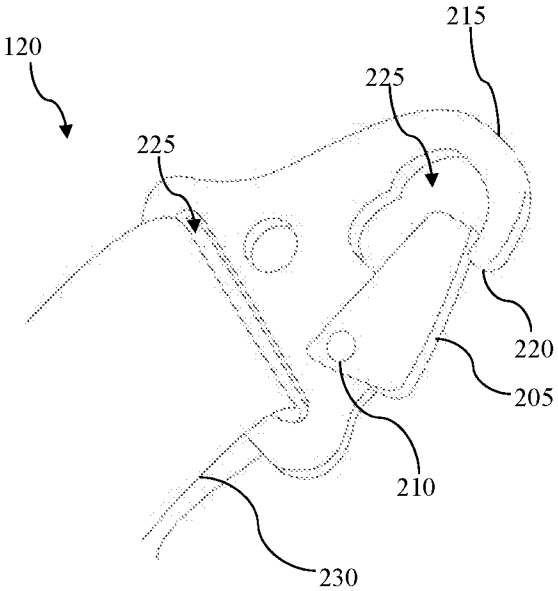
FIG. 2A is a perspective view of a first attaching member or snap hook of the sling in a closed position, according to an example embodiment.

Referring to FIGS. 2A and 2B, in one non-limiting embodiment, the first attaching member includes a body 215 having a hook feature 220 defining a semi-circular shaped opening 225 adapted to receive a first part of the weapon. A rectangular shaped gate 205 is adapted to pivot about a pivot point 210 and is adapted to be biased closed towards the hook feature. The lower end of the hook body of the first attaching member includes a slot or opening 235 that is adapted to receive webbing or a strap so that the first attaching member can be coupled to the loop. In FIG. 2A the first attaching feature is in the closed position. In the closed position, the body of the gate abuts against the hook feature preventing objects from exiting.

In FIG. 2B the first attaching member is in an open position. In the open position, the gate is pivoted about the pivot point 210 so that the upper end 206 of the gate is pivoted inward allowing a gap 240 between the edge of the gate and the hook feature. In the open position, the first attaching member can be attached to the first part of the weapon. In the present embodiment, the first part of the weapon is proximate to the lower end or butt end of the weapon. However, other locations on the weapon may also be used. In operation, in order for first attaching member to be attached to the weapon, force is applied to move the gate inwards so that a portion of the weapon can be inserted into the opening 225. After the portion of the weapon has been inserted into the opening, then, the biasing action of a spring moves the gate back to the closed position as illustrated in FIG. 2A. In other embodiments, other attaching devices or fasteners may be used such as a strap, a U Bolt, etc. However, such attaching devices or fasteners are not meant to be a limitation and other fasteners are within the spirit and scope of the present invention.

Referring back to FIG. 1, the sling include a cam buckle 130 attached to a second part of the loop 135. In the present embodiment, a first end 132 of the cam buckle is adapted for having an end of the first strap 110 threaded through it. The second end 134 of the body of the cam buckle is configured to couple to the second strap 115. However, as mentioned above, in other embodiments one strap may be used. The cam buckle is configured for decreasing the circumference of the loop so that the sling can tightened when worn against the user's body when a first force acts on a lever 131 of the cam buckle. The cam buckle is configured to decrease the circumference of the loop when a force is applied to the terminating end or handle 165 of the first strap (further explained below) that is threaded or passed through the body of the cam buckle. The cam buckle is further illustrated in FIGS. 5B, 6B and 7B and further illustrated below.

A trigger snap hook or attaching member 140 is also illustrated in FIG. 1. FIG. 1 also illustrates the configuration of how the device illustrated in FIGS. 8A-8C will be positioned after being attached to a one-point sling having cam buckle. In this document the term "attaching member" or "trigger snap hook" is used interchangeably. The trigger snap hook is coupled to a third part 145 of the loop. It is understood that other quick release mechanisms may also be used according to the parameters outlined below. The trigger snap hook is configured to removably couple the trigger snap hook and loop to a second part 415 of a weapon (as better illustrated in FIG. 3C). The trigger snap hook has a gate that is configured to be biased closed by a spring or some other biasing device and is configured to open when a force acts on a trigger 141 of the trigger snap hook.

Figure 5B:
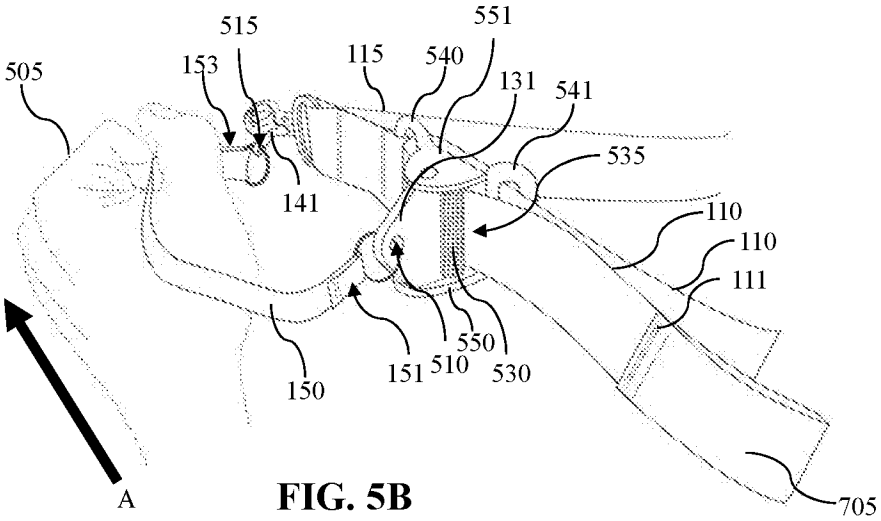
FIG. 5B is an enlarged perspective view of the content within Circle B of FIG. 5A.

The invention also includes a linking member 150. In the present embodiment, the linking member comprises a strap that can be made from material such as may be cotton flax, synthetic fibers such as nylon, polypropylene or polyester, Dyneema, and Kevlar etc. However, this is not meant to be a limitation and other types of materials may be used and are within the spirit and scope of the present invention. In the present embodiment, the first end 151 of the linking member is coupled to the lever of the cam buckle. The second end 153 of the strap is coupled to the trigger of the trigger snap hook. Referring to FIG. 5B, the first end of the strap is configured to couple to an aperture 510 on the lever of the cam buckle or lock by a ring the second end of the strap is configured to couple to an aperture 515 on the trigger of the trigger snap hook by a second ring. The first attaching member, or snap hook, second attaching member, or trigger snap hook, and lever of the cam buckle are arranged outwardly facing so that a user can easily access the lever of the cam buckle, actuator or trigger of the trigger snap hook and the gate of the first attaching member.

When the sling is in a two-point sling state, the sling is configured such that applying force on the linking member in a first direction (as illustrated as line A in FIG. 5B) causes a first force to act on the lever of the cam buckle causing the circumference of the loop to increase (further explained below). Applying force to the linking member in a second direction (as illustrated as line B in FIG. 6B) causes a second force to act on the trigger of the trigger snap hook causing the trigger snap hook to open. Applying force in a third direction (as illustrated as line C in FIG. 7B) on a terminating strap end of the loop or handle 705 received by the cam buckle causes the circumference of the loop to decrease.

When the sling is in a two-point sling state, the linking member allows a user to rapidly increase the circumference of the loop thereby loosening the strap, then, without releasing the linking member and in a subsequent motion decouple the trigger snap hook from the second part of the gun thereby converting the sling to a one-point sling state. When the sling is in a two-point sling state, the sling can be easily re-coupled to the second part of the weapon, and then tightened against a user's body.

Referring to FIG. 3A-3D, the trigger snap hook or attaching member is a trigger snap hook having a looped member 315. The looped member is configured to receive a strap and couple or attach a lower end 316 of the trigger snap hook to said third part of said strap. The trigger snap hook is such that the sagittal plane of the trigger snap hook is substantially aligned with the longitudinal axis of the loop (represented by line D) so that when force is applied to the trigger 141, the trigger rotates in a direction similar to curved line B. This configuration is such that the trigger snap hook opens or rotates towards the cam buckle away from the body of the trigger snap hook. The parameters of an attaching member other than a trigger snap hook is such that the attaching member opens when a pulling force act on the attaching member.

Figure 3C:
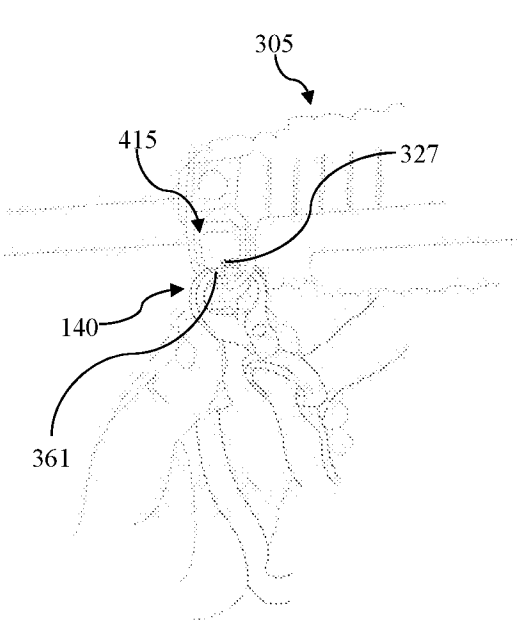
FIG. 3C is a perspective view of the attaching member, or trigger snap hook of the sling, in a partially open position positioned on a fore-end of a rifle with force applied to an actuator or trigger of the attaching member or trigger snap hook by a user's hand, according to an example embodiment.
Figure 3B:
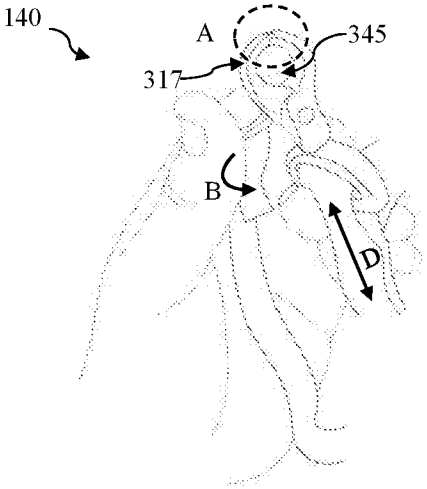
FIG. 3B is a perspective view of the attaching member, or trigger snap hook of the sling, in a closed position held by a user's hand, according to an example embodiment.

In the present embodiment, the trigger snap hook includes a body 320. In the present embodiment, the body has a curved or hook shape opposing a curved or hook shape of a gate 335 thereby defining a circular shaped opening 345. When in the closed position as illustrated in FIG. 3B, the circular shape opening 345 is configured to receive a portion of the weapon so as to couple the loop to the second part of the weapon. In the present embodiment, the second part of the weapon is proximate to the fore-end of the weapon. However, in other embodiments other parts of the weapon may be also be used.

The body of the trigger snap hook includes a latching end 325. Similarly, the gate includes a latching end 340 that is adapted to mate with the latching end of the body of the trigger snap hook. The latching end of the body includes a first curved feature 327 that is configured to mate with a second curved feature 341 of a latching end of the gate.

Figure 3D:
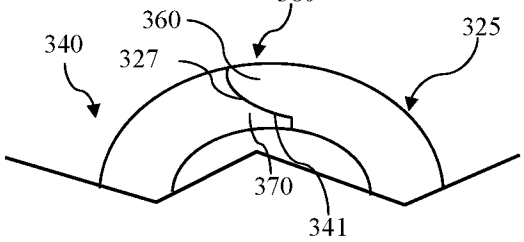
FIG. 3D is an enlarged side view of the content within Circle D of FIG. 3B.

FIG. 3D is an enlarged side view of the curved features of the latching ends of the trigger snap hook taken along broken circle A of FIG. 3B. Both FIGS. 3B and 3D illustrate the trigger snap hook in the closed position. The curved features overlap with each other proximate to the upper end 317 of the trigger snap hook when in the trigger snap hook is in the closed position. The curved features define an overlap of at least 3 mm-5 mm.

A first overlap protrusion 360 is on top a second overlap protrusion 370 defined by said curved features when the trigger snap hook is in the closed position. In the present embodiment, the first overlap protrusion is defined by the curved feature of the body and the second overlap protrusion is defined by the curved feature of the gate. However, it is understood that in other embodiments, the first overlap protrusion can be defined by the curved feature of the gate and the first overlap protrusion can be defined by the curved feature of the body. The overlap protrusions stacked on top of each other form a stop element 380 when in the closed position. The stop element increases an amount of force required to inadvertently de-couple the trigger snap hook from a weapon when the trigger snap hook is coupled to the weapon. In operation, when the trigger snap hook is attached to the second part of the weapon in the closed position, forces may push against the upper end 317 of the trigger snap hook along the surface proximate to the opening 345. When this occurs, the stop element increases the amount of force required to inadvertently remove the trigger snap hook from the weapon and such force is greater than the amount of force required to inadvertently remove the trigger snap hook from the weapon if the overlapping protrusions were side-by-side.

In operation, in order to open the trigger snap hook, an actuating member, such as a user's finger 310, would apply force to rotate the gate of the trigger snap hook open (similar to direction of curved line B). As the force is applied, in some embodiments, a spring or other biasing device is acted upon, and the gate is opened and moved away from the body of the trigger snap hook. When the force is removed from the trigger of the trigger snap hook, then the spring or other biasing device returns to its original state thereby causing the trigger to return to its original position and closing the device.

Figure 6B:
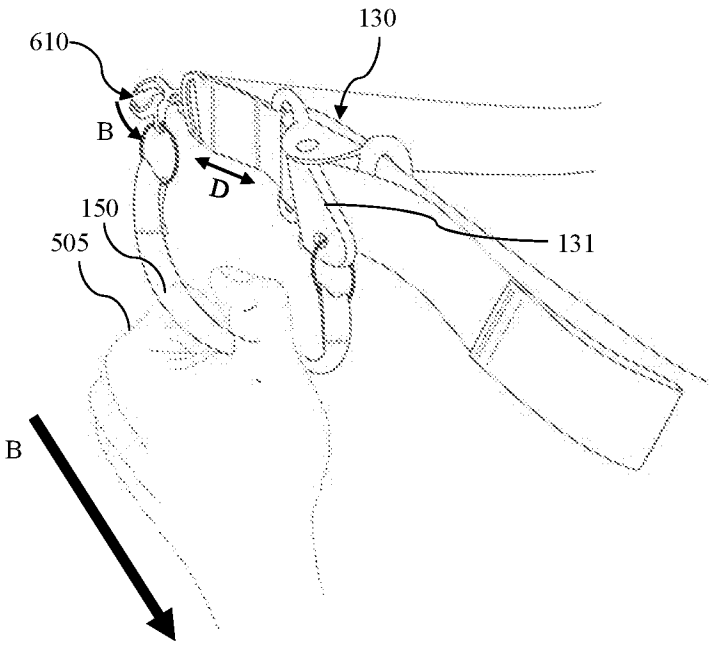
FIG. 6B is an enlarged perspective view of the content within Circle C of FIG. 6A.

If an attaching member other than a trigger snap hook is used, the attaching member must be configured to be opened in a matter such that applying force to the linking member in the direction of line B (as illustrated in FIG. 6B) opens the attaching device without having to release the linking member after the circumference of the loop is increased by applying force to the linking member in the direction of line A (as illustrated in FIG. 5B).

Figure 4:
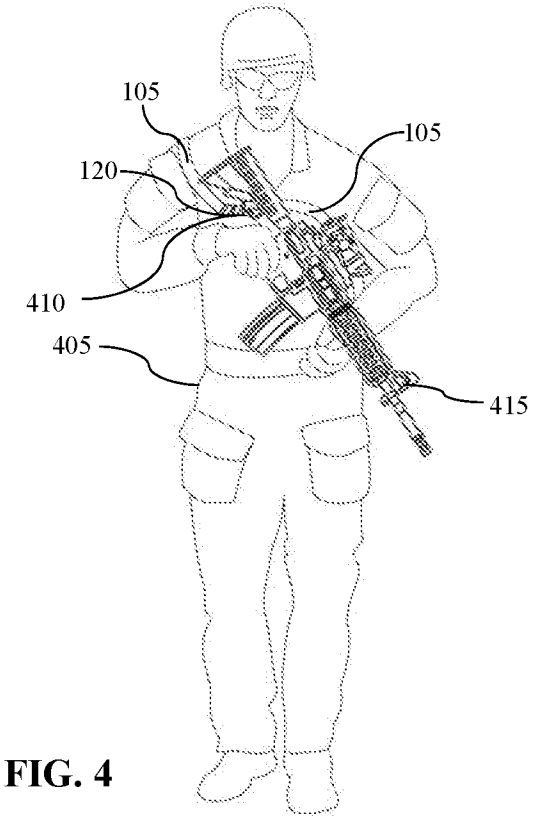
FIG. 4 is a perspective view of the sling coupled to a user in a two-point sling state, wherein the sling is attached close to a user's body, according to an example embodiment.

FIG. 4 is a front perspective view of a user with the sling attached to the weapon in a two-point sling state by the first attaching member 120 at the first part 410 of the weapon 305, and the second attaching member (not visible in this figure) attached to the second part of the weapon. The loop 105 is configured such that it wraps around the user's first shoulder and under a user's second shoulder crossing the torso of the user. In the present embodiment, the weapon positioned in front of the user's body. In FIG. 4 the loop is somewhat loose allowing a user to access a maneuver the weapon. In the present embodiment, the loop comprises two straps coupled together, however in other embodiments, other amounts of straps may also be used and are within the spirit and scope of the present invention. When the sling is tightened against a user's body a user can more easily travel with the weapon coupled closely the body of user thereby decreasing the amount of weapon movement. In operation, a user may desire to loosen the sling or increase the circumference of the loop. The present invention allows a user to increase the circumference of the loop by applying a force to the linking member 150.

Figure 5A:
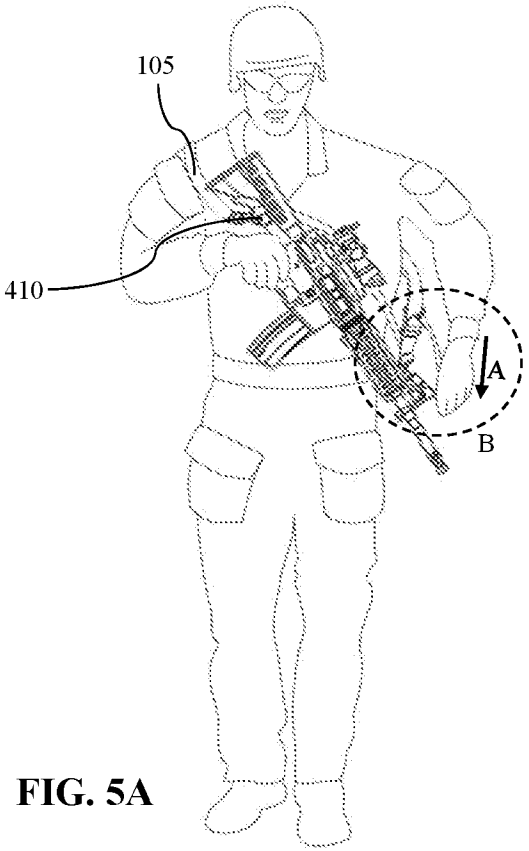
FIG. 5A is a perspective view of the sling coupled to a user in a two-point sling state, wherein a circumference of the sling has been increased by a user so that the user has room to maneuver the rifle, according to an example embodiment.

FIG. 5A is a perspective view of the sling coupled to a user in a two-point sling state. In FIG. 5A, the circumference of the sling has been increased by a user so that the user has room to maneuver the rifle. FIG. 5B is a perspective view of a user's hand applying force in the direction of line A to a linking member so that a cam buckle of the sling allows the circumference of the sling to be increased for a user has room to maneuver the rifle. FIG. 5B does not illustrate the rifle for purposes of illustration, but illustrates the components within circle B.

The cam buckle comprises 130 a body having a looped section 540 on one end of the cam buckle and a second loop section 541 on a second end of the cam buckle. Lever 131 is pivotally attached to sidewalls 550, 551. Protruding perpendicularly from the cam buckle body facing side of the lever is the locking element or gripping section 550. When in the locked position as illustrated in 6B, the locking element or gripping section 530 engages a portion of the strap that is run through the body of the cam buckle. When force is applied (as would be applied when force is applied to the linking member in the direction of line A) to the lever in order to move the lever away from the looped section 541 of the cam buckle, the locking element or gripping feature rotates upward causing the cam buckle to be moved into an open position. In the open position (as illustrated in FIG. 5B), when the gripping element 550 move upward, a gap 535 is formed. When the gap is formed, as in FIG. 5B, the strap that is run through the loop sections and through the cam body can be moved in both directions through the cam body.

In the present embodiment, a portion of the second strap 115 is attached to the loop section 540. A portion of the first strap 110 is received by loop section 541, then through loop section 540, then through the body of the cam buckle thereby forming a terminating end of the strap. The terminating end of the strap may be configured so that the thickness of the strap is increased thereby forming a handle 705. In the present embodiment, the handle is formed by the sewing together multiple segments of the strap, however in other embodiments other means of forming the handle may also be used.

Referring to FIG. 1, in the present embodiment, the first strap 110 may have a first terminating end 165 and a second terminating end 166. The second strap may have a first end 185 and a second end 190. In the present embodiment, the second attaching member 120 is coupled between the first and second straps by looped fasteners 191, 192 used for attaching straps. Such fasteners are well known to those skilled in the art. The first terminating end 165 of the first strap is passed through the loop sections 540, 541 and the body of the cam buckle. The second terminating end 166 of the strap passes through loop fastener 191 and wedding slider fasteners 160. It is understood that other types of fasteners and configurations for forming the loop may be used and are within the spirit and scope of the present invention. Wedding sliding fasteners can be used to adjust the circumference of the loop. It is understood that the wedding sliding fasteners 160 are configured so that they do not slide unless appropriately acted upon, which is well known to those skilled in the art. The second end 190 of the second strap passes through a series of looped fasteners and sliding fasteners so that the second end of the second strap is maintained in a stationary position. Similarly, such portion of the strap can be adjusted and such adjustable fasteners used for wedding or straps are well known to those skilled in the art. The first end 185 of the second strap is configured to attach to the looped section 540 of the cam buckle (as illustrated in FIG. 5B).

Referring to FIGS. 5A and 5B, in order to loosen the sling from a user's body, or to increase the circumference of the loop, a user will apply force in the direction of line A to the linking member. As force is applied to the linking member in the direction of line A, the lever 131 of the cam buckle rotates thereby causing the locking element or gripping section 530 of the cam to rotate away from the strap associated with the handle 705 causing the cam buckle to move into the open state or position. In the open state or position, a gap 535 is formed between the strap and the locking element or gripping section of the cam buckle. As the gap is formed, and as force is continually applied substantially in the direction of line A to the linking member, the circumference of the loop is increased. When the circumference of the loop is increased as illustrated in FIG. 5B, a user can more easily maneuver a weapon. Similarly, the device 800 operates in the same manner when coupled to a one-point sling having a cam buckle (explained below and illustrated in FIG. 8A-8D).

Figure 6A:
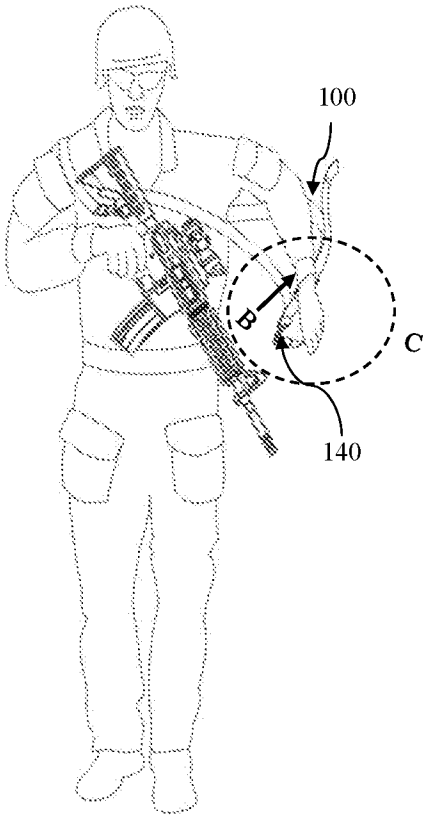
FIG. 6A is a perspective view of the sling coupled to a user in a one-point sling state, wherein the attaching member or trigger snap hook has been decoupled from the rifle.

Referring to FIGS. 6A and 6B, FIG. 6A is a perspective view of the sling coupled to a user in a one-point sling state, wherein the attaching member or trigger snap hook 140 has just been removed from the rifle. FIG. 6B is a perspective view of a user's hand applying force in the direction of line B to a linking member such that the trigger snap hook is in an open state allowing the user to de-couple the trigger snap hook from the rifle. In FIG. 6B the rifle was not shown for illustration purposes. The sling is configured such that applying force to the linking member 150 in the direction of line B causes forces to act on the trigger of the trigger snap hook causing the trigger snap hook to open. When forces are applied to the linking member substantially in the direction of line B, forces are then applied to the trigger 141 of the trigger snap hook causing the trigger snap hook to rotate open in the direction of curved line B causing the snap hook gate to open allowing the trigger snap hook to be de-coupled from the weapon changing the sling into the one-point sling state. Similarly, the device 800 operates in the same manner when coupled to a one-point sling having a cam buckle (explained below and illustrated in FIG. 8A-8D).

The linking member connecting the lever of the cam buckle can be moved in a first direction (such as in the direction of line A as illustrated in FIG. 5B), then subsequently moved in the direction of line B without ever releasing the linking member. In operation, a user will use an actuator, such as a user's hand 505, to apply forces to the linking member. When the sling is coupled to a weapon in the two-point sling state, applying force on the linking member in the direction of line A (as illustrated in FIGS. 5A and 5B), causes force to act on the lever of the cam buckle causing the circumference of the loop to increase. This provides a user with greater space to maneuver a weapon. Next, applying force to the linking member substantially in the direction of line B, causes force to act on the trigger of the trigger snap hook causing the snap hook gate to open allowing the trigger snap hook to be de-coupled from the weapon converting the two-point sling into a one-point sling state. When the sling is in a one-point state, a user can easily maneuver the weapon and fire the weapon. Similarly, the device 800 operates in the same manner when coupled to a one-point sling having a cam buckle (explained below and illustrated in FIG. 8A-8D).

Figure 3A:
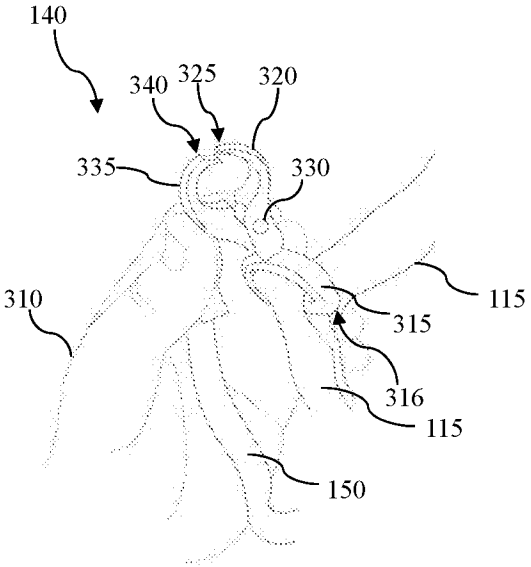
FIG. 3A is a perspective view of an attaching member, or trigger snap hook of the sling, in an open position with force applied to an actuator or trigger of the trigger snap hook by a user's hand, according to an example embodiment.
Figure 7B:
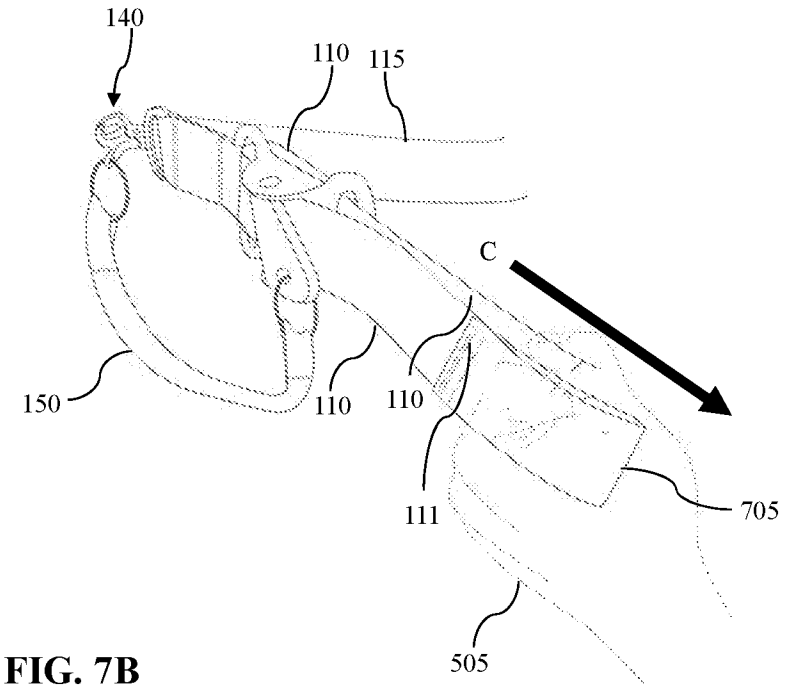
FIG. 7B is an enlarged perspective view of the content within Circle D of FIG. 7A.
Figure 7A:
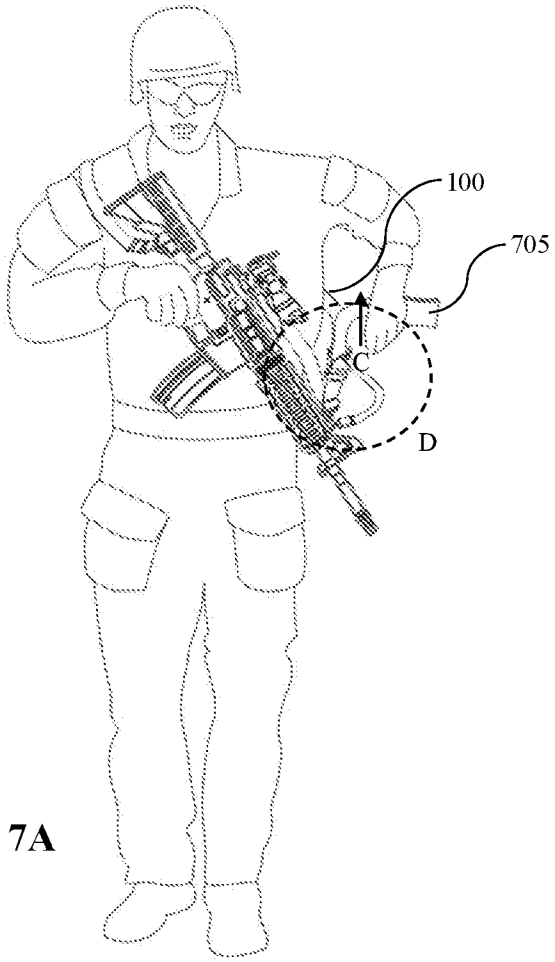
FIG. 7A is a perspective view of the sling worn by a user, wherein the sling is in a two-point sling state, and wherein a user's hand is applying force in the direction of line C to a handle of the loop thereby decreasing the circumference of the sling to tighten the sling against the user's body, according to an example embodiment.

Referring to FIGS. 7A and 7B, FIG. 7A is a perspective view of the sling re-coupled to a user in a two-point sling state and wherein a user's hand is applying force in the direction of line C to a portion of the loop (handle 705) thereby decreasing the circumference of the sling to tighten the sling against the user's body. FIG. 7B is a perspective view of a user's hand applying force in the direction of line C to a portion of the sling thereby decreasing the circumference of the sling, without illustrating the weapon or other parts of the user. In operation, when the sling is coupled to a weapon in the one-point sling state (as illustrated in FIGS. 6A and 6B) a user can use an actuator or actuating member, such as a user's fingers a hand to apply force on the trigger 141 of the trigger snap hook causing the snap hook gate to open (as illustrated in FIGS. 3A and 3C) thereby allowing the trigger snap hook to be removably coupled to a second part of the weapon or proximate to the front end of the weapon. Referring to FIGS. 7A and 7B, applying force in substantially in the direction of line C to the terminating strap end or handle 705 causes the circumference of the loop to decrease thereby allowing a user to tighten the sling against the user's body. Similarly, the device 800 operates in the same manner when coupled to a one-point sling having a cam buckle (explained below and illustrated in FIG. 8A-8D).

The linking member provides a greater surface area in order for a user to locate the trigger or actuator on a trigger snap hook or attaching member, especially when under high levels of stress such as in combat. The linking member also provides an easy way for a user to move from the trigger or actuator of the trigger snap hook or attaching member to the cam buckle. In operation, the greater surface area provided by the linking member spanning from the trigger of the trigger snap hook 140 to the lever 131 of the cam buckle provides a greater surface area for a user to find the trigger snap hook when the user cannot observe the trigger snap hook. Additionally, the linking member acts as a guide so that after a user couples the trigger snap hook to the second part of a weapon, a user can easily use the linking member as a guide to move backwards along the linking member towards the handle to more quickly tighten the strap. Additionally, the configuration of the looped member 315 of the attaching member or trigger snap hook coupled or attached to lower end 316 of the trigger snap hook is such that the sagittal plane of the trigger snap hook is aligned with the longitudinal axis of the loop so that the opening of the looped member 316 also allows for improved function. The trigger snap hook is such that the sagittal plane of the trigger snap hook is substantially aligned with the longitudinal axis of the loop (represented by line D) so that when force is applied to the trigger 141, the trigger rotates substantially in the direction of curved line B. This configuration is such that the trigger snap hook opens or rotates towards the cam buckle away from the body of the trigger snap hook. This configuration allows a user to easily apply force using an actuating member, such as a user's hand, to the linking member in a first direction (as illustrated as line A in FIGS. 5A and 5B) and, then to apply force in a second direction (as illustrated as line B in FIGS. 6A and 6B) without the actuating member disengaging (or the user's hand releasing) from the linking member. This configuration provides an improved and more efficient way of moving between a two-point and one-point sling. Similarly, the device 800 operates in the same manner when coupled to a one-point sling having a cam buckle (explained below and illustrated in FIG. 8A-8D).

Figure 8B:
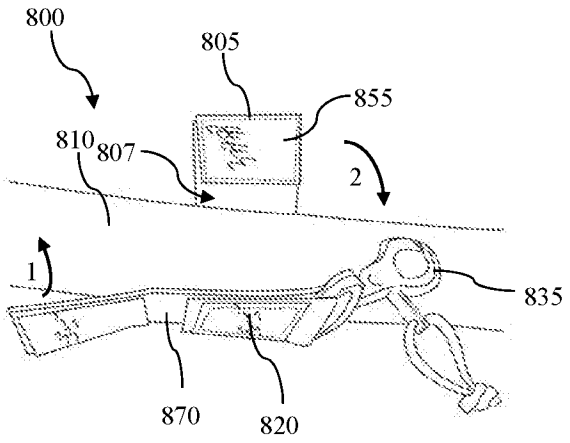
FIG. 8B is a perspective view of the device proximate to a strap of a one-point sling.
Figure 8D:
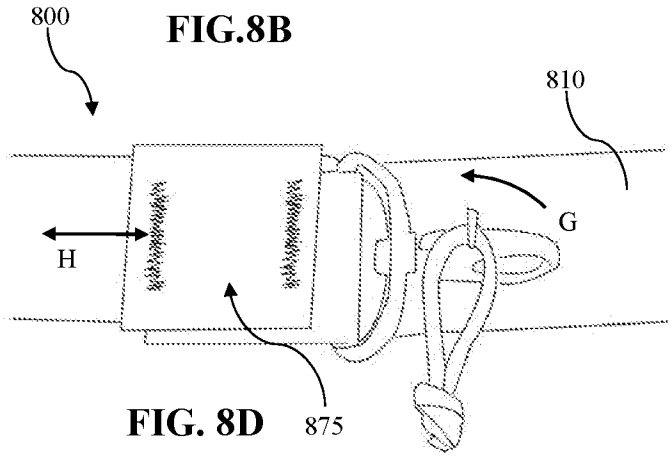
FIG. 8D is a perspective view of the device fully attached to a portion of a one-point sling.
Figure 8A:
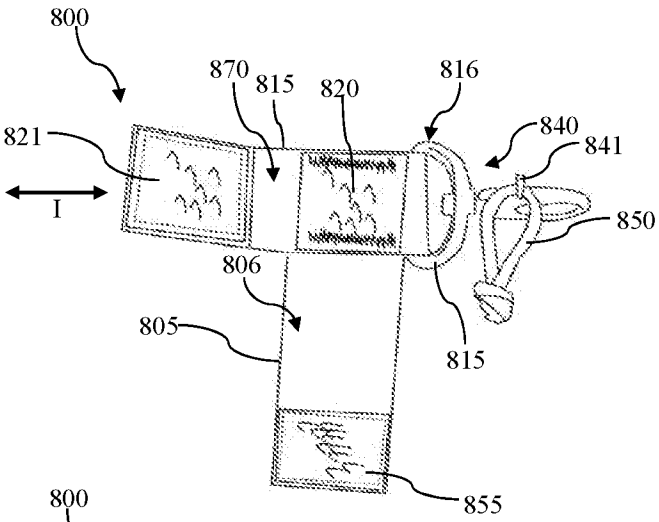
FIG. 8A is a perspective view of a device for attaching to a one-point sling.

FIG. 8A is a perspective view of a device 800 for attaching to a one-point sling. The device can be used to quickly convert between the one-point sling state and a two-point sling state. In operation, the device will be coupled to the loop for the to be operated similar to the sling described in FIGS. 1-7.

The device 800 is configured to couple to a webbing or a strap (as illustrated as 810 in FIG. 8D) of a one-point gun-sling. One-point slings are well known to those skilled in the art as explained above. The one-point sling may include a cam buckle and can be similar to the cam buckle 130 illustrated in FIG. 1 and explained above. Similar to the cam buckle 130, the cam buckle of the one-point gun sling is used to increase or decrease circumference of the gun sling. The cam buckle is configured for adjusting a circumference of the one-point gun sling. Cam buckles used for decreasing and increasing the circumferences of loop straps are well known to those skilled in the art. Many cam buckles come standard with an aperture drilled into the lever of the cam buckle (as illustrated in the figures above as opening or aperture 510 on the lever 131).

An attaching member 840 of the device is configured to removably couple the attaching member proximate to a second part of a weapon (similar to how the trigger snap hook 140 of the sling attaches to a weapon). The trigger snap hook or attaching member 840 of the device is similar and operates in a manner similar to the trigger snap hook 140. The trigger snap hook includes an actuator or trigger 841 similar to the trigger or actuator 141 of the sling described above. Similar to the trigger snap hook or second attaching member described above, the trigger snap hook is configured so that a gate 835 of the trigger snap hook is biased closed. Similar to the trigger snap hook 140 described above, the gate of the attaching member is configured to open when a force acts on the actuator 841 of the attaching member. In operation, in order to open the attaching member or trigger snap hook, an actuating body, such as a user's hand (similar to what is shown in FIGS. 3A-3C) will apply force to the actuator or trigger so that the gate of the trigger snap hook opens allowing a user to couple the device to a second part of a weapon.

The device includes a linking member 850. Similar to the sling 100, a linking member 850 of device 800 is configured to couple the actuator 841 of the attaching member to a lever of a cam buckle of the one-point gun sling. In the present embodiment, the linking member comprises a strap or some other elongated material, such as a strap, webbing, piece of rope, twine, etc., that is threaded through an opening or aperture on the actuator or trigger of the attaching member. In the present embodiment, the linking member is a cord. However, other types of devices that are able to connect the actuator of the trigger snap hook to the linking member may be used (similar to how the linking member connects the actuator of the trigger snap hook to the lever of the cam for sling 100 described above).

The lower end 816 of the attaching member or trigger snap hook is configured to couple to webbing of a one-point gun sling (as illustrated as 810 in FIG. 8D). In the present embodiment, the lower end of the trigger snap hook includes a looped section 815 similar to the loop section of the trigger snap hook 140 described above. In one embodiment, a first attaching strap 815 is coupled to the loop sections such that the sagittal plane of the trigger snap hook is substantially aligned with the longitudinal axis (represented by line I) of the first attaching member. A second attaching strap 805 is coupled to the first attaching strap so that the second attaching strap is perpendicularly aligned to the first attaching strap. The attaching straps also may include a plurality of fasteners for coupling the trigger snap hook to a strap of the loop of a one-point sling. Fasteners may include, snaps, buckles, webbing fasteners, hook and loop fasteners, etc. However other fasteners may also be used and are within the spirit and scope of the present invention. The first attaching strap has a first side or surface 870 opposing a second side or surface 875. The second attaching strap also has a first side or surface 806 and an opposing second side or surface 807. In the present embodiment, portions of hook and loop fasteners, 820, 821, 855, 860 are presented on the sides of the first and second straps in order to attach the device onto the strap or webbing of a one-point gun sling. It is understood that other types of fasteners may be used. In the present embodiment, the fastener 821 is configured to correspond and mate with fastener 860, and fastener 855 is configured to correspond and mate with fastener 820.

Figure 8C:
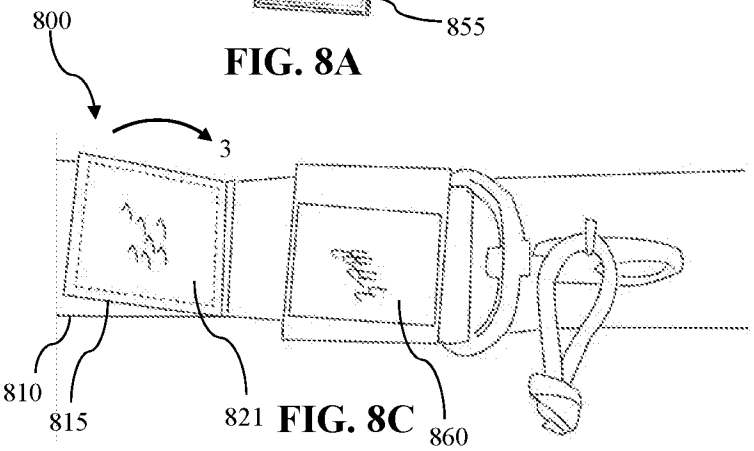
FIG. 8C is a perspective view of the device partially attached to a portion of a one-point sling.

To install the device onto the wedding or straps of a one-point gun sling, the devices is first positioned as illustrated in FIG. 8B. In FIG. 8B, the second attaching strap 806 is positioned such that it wraps under sling strap 810. Next, the first attaching strap 815 is folded towards strap 810 in the direction of curved line 1 so that the first surface 870 of the first attaching strap faces outwards and the second surface 875 of the first attaching strap is facing towards the sling strap 810. Next, the second attaching member 805 is folded towards the strap in the direction of curved line 2. As mentioned above, fastener 855 is configured to correspond and mate with fastener 820. When the second attaching member is folded towards the strap, fastener 855 mates with fastener 820 as illustrated in FIG. 8C. Next, the part of the first attaching strap 815 that is not covered by the second attaching strap (as illustrated in FIG. 8C) is folded downwards in the direction of curved line 3 so that fastener 821 mates with and couples to fastener 860 (as illustrated in FIG. 8D). When in the fully attached position, the device is such that the sagittal plane of the trigger snap hook is substantially aligned with the longitudinal axis (represented by line H) of the loop of the sling. Such configuration allows for the trigger snap hook gate to open or rotates towards the cam buckle when positioned on the sling. When the device is attached to the strap of a one-point gun sling, the device converts the one-point gun sling into a two-point gun sling that can quickly move between a two-point gun sling in a one-point gun sling.

After the device 100 has been attached to the strap or webbing, the linking member can be coupled to the lever of the cam buckle. In the present embodiment, the device 800 includes a cord as a linking member. However, it is understood that other linking members may also be used. The cord can be threaded through an aperture on the lever of the cam buckle or coupled to the aperture on the lever of the cam buckle using a ring (as illustrated in FIG. 5). The linking member connects the attaching member 840 and the cam buckle so that when the device is in a two-point gun sling state, a user can apply force on to an actuating member in a first direction (as illustrated in FIGS. 5A and 5B), and apply force in said second direction (as illustrated in FIGS. 6A and 6B) without the actuating member or user's hand disengaging or releasing from the linking member, which allows a user to easily loosen the circumference of the sling and de-couple the attaching member from the second part of the weapon.

Similar to the linking member of the sling 100, the linking member provides a greater surface area in order for a user to locate the trigger on the trigger snap hook, especially when under high levels of stress such as in combat. The linking member 850 also provides an easy way for a user to move from the trigger of the trigger snap hook to the cam buckle. In operation, the greater surface area provided by the linking member spanning from the actuator 841 of the attaching member to the lever of the cam buckle of a one-point gun makes it easier for a user to find the attaching member when the user is not directly in the line of sight of the attaching member. Additionally, the linking member acts as a guide so that after a user couples the trigger snap hook to the second part of a weapon, a user can easily use the linking member as a guide to move backwards along the linking member towards the handle to more quickly tighten the strap. Additionally, the configuration of the looped member 815 of the attaching member coupled or attached to lower end 816 of the attaching such that the sagittal plane of the trigger snap hook is substantially aligned with the longitudinal axis of the loop allows for improved function. The trigger snap hook is such that the sagittal plane of the trigger snap hook is aligned with the longitudinal axis of the loop (represented by line H) so that when force is applied to the actuator 841, the trigger rotates in a direction similar to curved line G. This configuration is such that the trigger snap hook opens rotates towards the cam buckle away from the body of the trigger snap hook. This configuration allows a user to easily apply force using an actuating member, such as a user's hand, to the linking member in a first direction (as illustrated as line A in FIGS. 5A and 5B) and then apply force in a second direction (as illustrated as line B in FIGS. 6A and 6B) without the actuating member disengaging (or the user's hand letting go) from the linking member. This configuration provides an improved and more efficient way of moving between a two-point and one-point sling.

The device 800 is configured such that applying force on the linking member in a first direction (as illustrated in FIGS. 5A-5C) causes a first force to act on the lever of the cam buckle causing the circumference of the loop to increase. The device is also configured such that applying force to the linking member in a second direction (as illustrated in FIGS. 6A-6C) causes a second force to act on the actuator of the attaching member causing the attaching member to open. Applying force in a third direction on a terminating strap end of webbing of the loop received by the cam buckle causes the circumference of the loop to decrease direction (as illustrated in FIGS. 7A-7C).

While device 800 may include a trigger snap hook or an attaching member 840. However, it is understood that other types of attaching members may be used that fulfill the parameters described for proper operation of the invention. The lower end 816 of the attaching member or trigger snap hook is configured to couple to webbing of a two-point gun-sling (as illustrated as 810 in FIG. 8D).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A sling configured for changing between a two-point sling state and a one-point sling state comprising:

at least one strap configured to define a loop, wherein the loop is configured is to be positioned over a user's first shoulder and under a user's second shoulder;

a first attaching member, wherein the first attaching member is attached to a first part of the loop, and wherein the first attaching member is configured to couple the loop to a first part of a weapon;

a cam buckle, wherein the cam buckle is attached to a second part of the loop, wherein the cam buckle is configured for adjusting a circumference of the loop, and wherein the circumference of the loop can be increased when a first force acts on a lever of the cam buckle;

a trigger snap hook, wherein the trigger snap hook is attached to a third part of the loop, wherein the trigger snap hook is configured to removably couple the trigger snap hook to a second part of a weapon, wherein the trigger snap hook is configured to be biased closed, and wherein a gate of the trigger snap hook is configured to open when a second force acts on a trigger of the trigger snap hook; and, a linking member, wherein a first end of the linking member is attached to the trigger of the trigger snap hook, and wherein a second end of the linking member is attached to the lever of cam buckle.

2. The sling of claim 1, wherein the sling is configured such that applying force on the linking member in a first direction causes said first force to act on the lever of the cam buckle causing the circumference of the loop to increase, applying force to the linking member in a second direction causes said second force to act on the trigger of the trigger snap hook causing the trigger snap hook to open, and applying force in a third direction on a terminating strap end of the loop received by the cam buckle causes the circumference of the loop to decrease.

3. The sling of claim 2, wherein when the sling is attached to a weapon in the two-point sling state, applying force on the linking member in the first direction causes said first force to act on the lever of the cam buckle causing the circumference of the loop to increase providing a user with greater space to maneuver a weapon, and applying force to the linking member in the second direction causes said second force to act on the trigger of the trigger snap hook causing the snap hook gate to open allowing the trigger snap hook to be detached from the weapon.

4. The sling of claim 2, wherein when the sling is attached to a weapon in the one-point sling state, applying force on the trigger of the trigger snap hook causing the snap hook gate to open thereby allowing the trigger snap hook to be removably attached to a second part of the weapon, and wherein applying force in the third first direction to the terminating strap end received by the cam buckle causes the circumference of the loop to decrease thereby allowing a user to tighten the sling against the user's body.

5. The sling of claim 1, wherein the first part of the weapon is proximate to a rearward-end of the weapon.

6. The sling of claim 1, wherein the second part of the weapon is proximate to the fore-end of the weapon.

7. The sling of claim 1, wherein the linking member comprises a strap having a first end opposing a second end, wherein the first end of the linking member is configured to couple to the lever of the cam buckle, and wherein the second end of the strap is configured to couple to the trigger of the trigger snap hook.

8. The sling of claim 1, wherein the trigger snap hook comprises:

a looped member configured to attach a lower end of the trigger snap hook to said third part of said strap such that the sagittal plane of the trigger snap hook is substantially aligned with the longitudinal axis of the loop;

a body having a latching end, wherein the latching end of the body comprises a first curved feature configured to mate with a second curved feature of a latching end of the gate;

a latching end of the gate, wherein the latching end of the gate comprises a second curved feature, wherein the second curved feature is configured to mate with the first curved feature, and wherein the gate is configured to open outward away from the body of the trigger snap hook; and, wherein said curved features overlap each other proximate to an upper end of the trigger snap hook when the snap hook is in a closed position.

9. A sling for configured for changing between a two-point sling state and a one-point sling state comprising:

a first strap configured to couple to a second strap defining a loop, wherein the loop is configured is to be positioned over a user's first shoulder and under a user's second shoulder;

a snap hook, wherein the snap hook is removably attached to a first part of the loop, wherein the snap hook is configured to couple the loop proximate a butt end of a weapon;

a cam buckle, wherein the cam buckle is attached to a second part of the loop, wherein the cam buckle is configured for adjusting a circumference of the loop, wherein the circumference of the loop can be increased when a first force acts on a lever of the cam buckle;

a trigger snap hook, wherein the trigger snap hook is attached to a third part of the loop, wherein the trigger snap hook is configured to removably couple the third part of the loop proximate to a fore-end of a weapon, wherein the trigger snap hook is configured to be biased closed, and wherein a gate of the trigger snap hook is configured to open when a second force acts on a trigger of the trigger snap hook;

a linking member, wherein a first end of the linking member is attached to the trigger of the trigger snap hook, and a second end of the linking member is attached to the lever of cam buckle; and, wherein the sling is configured such that applying force on the linking member in a first direction causes said first force to act on the lever of the cam buckle causing the circumference of the loop to increase, wherein applying force to the linking member in a second direction causes said second force to act on the trigger of the trigger snap hook causing the snap hook gate to open, and wherein applying a third force to a terminating strap end of the loop received by the cam buckle in a third direction causes the circumference of the loop to decrease the circumference of the loop.

10. The sling of claim 9, wherein the trigger snap hook comprises:

a looped member configured to attach a lower end of the trigger snap hook to the third part of strap such that the sagittal plane of the trigger snap hook is substantially aligned to the longitudinal axis of the loop;

a body having a latching end, wherein the latching end of the body comprises a first curved feature configured to mate with a second curved feature of a latching end of the gate;

a latching end of the gate, wherein the latching end of the gate comprises a second curved feature, wherein the second curved feature is configured to mate with the first curved feature, and wherein the gate is configured to open outward away from the body of the trigger snap hook; and, wherein said curved features overlap each other proximate to an upper end of the trigger snap hook when the snap hook is in a closed position.

11. The sling of claim 10, wherein the curved features define an overlap of at least 3 mm-5 mm.

12. The sling of claim 10, wherein a first overlap protrusion is on top a second overlap protrusion defined by said curved features when the trigger snap hook is in the closed position, wherein said overlap protrusions form a stop element when in the closed position, and wherein the stop element increases an amount of force required to inadvertently de-couple the trigger snap hook.

13. The system of claim 10, the linking member is configured such that a user can apply force with an actuating member in said first direction, and apply force in said second direction without the actuating member disengaging from the linking member.

14. The sling of claim 9, when the sling is attached to a weapon in the two-point sling state, applying force on the linking member in the first direction causes said first force to act on the lever of the cam buckle causing the circumference of the loop to increase providing a user with greater space to maneuver a weapon, and applying force to the linking member in the second direction causes said second force to act on the trigger of the trigger snap hook causing the snap hook gate to open allowing the trigger snap hook to be detached from the weapon changing the sling into the one-point sling state.

15. The sling of claim 12, when the sling is attached to a weapon in the one-point sling state, applying force to the linking member in the second direction causes said second force to act on the trigger of the trigger snap hook causing the snap hook gate to open thereby allowing the trigger snap hook to be removably attached to a second part of the weapon changing the sling into the two-point sling state, and wherein supplying force in a third direction to the terminating strap end received by the cam buckle causes the circumference of the loop to decrease allowing the sling to tighten the system against the user's body.

16. The sling of claim 12, wherein the snap hook, trigger snap hook, and cam buckle are arranged outwardly facing.

17. The sling of claim 10, wherein the linking member comprises a strap having a first end opposing a second end, wherein the first end of the strap is configured to couple to an aperture on the lever of the cam buckle by a ring, and wherein the second end of the strap is configured to couple to an aperture on the trigger of the trigger snap hook by a second ring.

18. A device for attaching to a one-point sling comprising:

an attaching member, wherein the attaching member is configured to attach to a loop of the one-point gun-sling, wherein the attaching member is configured to removably attach the attaching member proximate to a second part of a weapon, wherein a gate of the attaching member is configured to be biased closed, and wherein the gate of the attaching member is configured to open when a force acts on an actuator of the attaching member; and, a linking member, wherein the linking member is configured to attach the actuator of the attaching member to a lever of a cam buckle of the one-point gun sling, wherein the cam buckle is configured for adjusting a circumference of the one-point gun sling.

19. The device of claim 18, wherein the attaching member comprises:

a trigger snap hook having a looped section at a lower end of the trigger snap hook, wherein the looped section is configured for coupling to a first attaching strap;

a first attaching strap, wherein the first attaching strap is configured for coupling to the looped section;

a second attaching strap attached to the first attaching strap, wherein the second attaching strap extends perpendicular from the first attaching strap; and, a plurality of fasteners on surfaces of the first attaching strap and the second attaching strap, wherein the fasteners are configured for coupling the device to the sling the such that the sagittal plane of the trigger snap hook is substantially aligned with the longitudinal axis of the loop when the device is attached to the loop.

20. The device of claim 18, wherein when the device is attached to a one-point gun sling and the linking member couples the actuator of the device to the lever of the cam buckle of the one-point gun sling, applying force on the linking member in a first direction causes a first force to act on the lever of the cam buckle causing the circumference of the loop to increase, applying force to the linking member in a second direction causes a second force to act on the actuator of the attaching member causing the attaching member to open, and wherein a user can apply force with an actuating member in a first direction and apply force in said second direction without the actuating member disengaging from the linking member.

* * * * *